US006850731B2

(12) United States Patent
Ferlitsch

(10) Patent No.: US 6,850,731 B2
(45) Date of Patent: Feb. 1, 2005

(54) SPLIT-STREAM RE-UNITING OF PRINT-DOCUMENT PAGES

(75) Inventor: Andrew R. Ferlitsch, Tigard, OR (US)

(73) Assignee: Sharp Laboratories of America, Inc., Camas, WA (US)

( * ) Notice: Subject to any disclaimer, the term of this patent is extended or adjusted under 35 U.S.C. 154(b) by 0 days.

(21) Appl. No.: 10/389,309

(22) Filed: Mar. 14, 2003

(65) Prior Publication Data

US 2004/0179883 A1 Sep. 16, 2004

(51) Int. Cl.[7] ..... G03G 15/00
(52) U.S. Cl. ..... 399/403; 399/397; 400/625
(58) Field of Search ..... 399/403, 397; 400/625, 624, 76; 358/1.12, 1.15

(56) References Cited

U.S. PATENT DOCUMENTS 6,241,404 B1 6/2001 Fietze et al. ..... 400/76
6,407,820 B1 6/2002 Hansen et al. ..... 358/1.12
6,636,327 B2 * 10/2003 Yoshida et al. ..... 358/1.15
2001/0043358 A1 * 11/2001 Schwartz ..... 358/1.15
2002/0105672 A1 8/2002 Housel ..... 358/1.15

FOREIGN PATENT DOCUMENTS

WO WO99/36338 A1 7/1999

* cited by examiner

*Primary Examiner*—Anthony H Nguyen
(74) *Attorney, Agent, or Firm*—Jon M. Dickinson, P.C.; Robert D. Varitz, P.C.

(57) ABSTRACT

Split-stream re-uniting of document pages where such pages have followed divided flow paths toward a collator. Control over proper, successive-page feeding from divided feed sources to the collator is provided by PDL-carried page-feed instructions which are "embedded" in the related, document-job PDL information—executed by a PDL interpreter. "Ghost" pages are created and "fed" with appropriate timing to accommodate proper successive page insertion from another feed source, thus to accomplish smoothly flowing, properly sequenced document assembly.

9 Claims, 2 Drawing Sheets

*Print Job*

- Print Job Header
- Page 1 Preamble
- Page 1 Page Data
- Page 2 Preamble
- Page 2 Page Data
- ...
- Page N Preamble
- Page N Page Data → *Preamble*

- Media Source
- Paper Size
- Orientation
- Print Direction
- Resolution
- Picture Frame
- Cursor Position Media Source → opcode
N = Media Source operand
1 = Tray 1
2 = Tray 2
3 = Tray 3
4 = Tray 4
5 = LCC
6 = Manual Feed
7 = Envelope Feed
8 = Post Fuser

SPLIT-STREAM RE-UNITING OF PRINT-DOCUMENT PAGES

BACKGROUND AND SUMMARY OF THE INVENTION

This invention relates to a print-job system and methodology. In particular it relates to such a system and methodology which offer special control over the flow of successive document pages for proper collation, where different pages in the job have followed different, respective flow paths during implementation of the job. The term "print job" and the like as used herein is intended to refer generally to any imaging job out of which printed pages emerge for assembly into a final document.

A good illustration (from many which could be chosen) of where practice of the present invention offers special utility can be visualized in the context of a document imaging job, such as a document scanning, copying and/or printing job, wherein certain pages are entirely black-and-white pages, and other pages are entirely, or partially, color-containing pages. In such a job, it is typical that purely black-and-white pages follow one processing flow path, whereas pages containing color follow another flow path.

Where document imaging jobs are thus handled as split jobs for various reasons, proper reuniting of pages in the correct order during collation is of course necessary. Such reuniting has been handled in the past by a number of different techniques which are, for one reason or another, either relatively complex, or somewhat expensive to implement, or both.

The present invention addresses this issue with an approach which focuses upon incorporating, into job-specific, page-description (PDL) language, page-handling, or page-feed, instructions which include instructions that specify different "plural-stream" sources as direct feed sources for a job-page collator. Very specifically, in a job wherein two flow streams, or paths, are followed, one by black-and-white pages, and other by color-containing pages, two different path-associated feed "trays", such as a pre-fuser tray, and a post-fuser tray, may be employed as sources for the "feeding or pulling" of pages into an associated collator. Where, as in many documents, the black-and-white pages outnumber the color-containing pages, in accordance with practice of the present invention, the black-and-white pages will follow the pre-fuser path/tray route, and the color-containing pages the post-fuser path/tray route.

Utilizing the present invention, by incorporating such page-feed instructions in the PDL associated with a specific job, complexities which attend various prior art practices are avoided, as are elevated handling expenses. With PDL page-feed instructions embedded within the "boundaries" of a given document imaging job, these instructions are implemented after interpretation by an appropriate PDL interpreter, which then effectively controls respective-path, page-feed, or page-flow, activities. This is all accomplished in accordance with appropriate timing so that correct, next-adjacent, successive pages are fed in the right order to a collator.

In this context, the present invention implements a unique practice whereby virtual, or ghost pages, are created, especially in the pre-fuser feed line of document pages. These ghost pages act as surrogates for certain real pages which are following another flow path, such as pages which follow a color-imagery flow path. When a ghost page appears in a path, a real page is pulled, or fed, from the other path, and the result is a properly collated final document. From the point of view of the flow of document pages through and along the pre-fuser path, the presence of such ghost pages causes that flow path to see, effectively, a continual flow of document pages, notwithstanding the fact that there is actually an interleaving kind of flow taking place between two or more document page paths, all accommodated by the presence of such properly timed ghost pages under the control of the PDL page-feed instructions.

The various features and advantages of the invention just suggested will become more fully apparent as the description which now follows is read in conjunction with the accompanying drawings.

DETAILED DESCRIPTION OF THE DRAWINGS

Figures 1, 2:
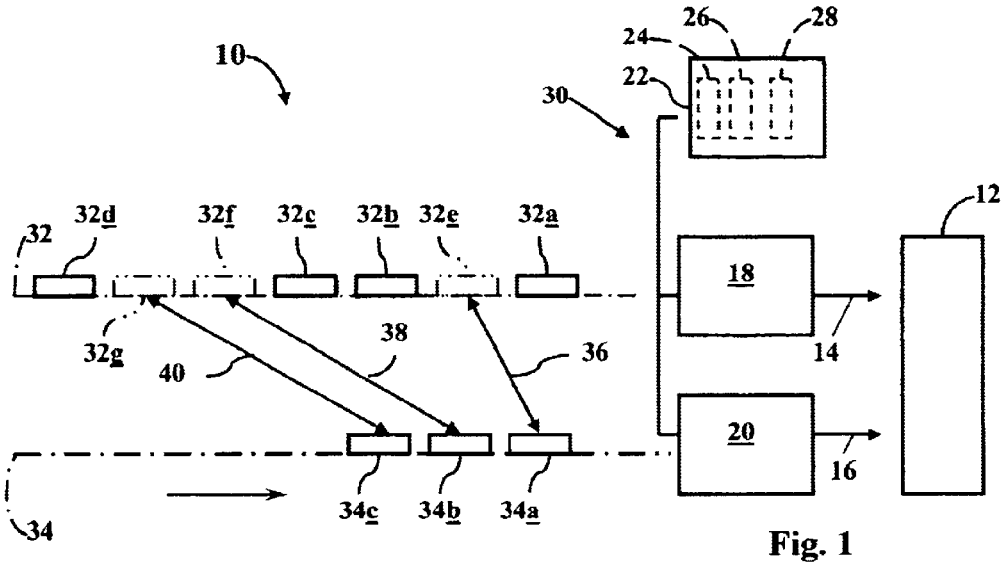
FIG. 1 is a simplified block/schematic diagram illustrating both the system and the methodology of the present invention.
FIG. 2 illustrates an implementation of the invention wherein, in accordance with the structuring of PDL content relative to a document imaging job, a post-fuser is treated as a source input for page reception by, for example, a collator.

Turning attention now to the drawings, and referring first of all to FIG. 1, indicated generally at 10 are both a system, and a graphical representation of a methodology, built and acting in accordance with a preferred and best mode embodiment of, and manner of practicing, the present invention. Describing what is shown in FIG. 1 from a systemic point of view, indicated generally at 12 is an output collator. Collator 12 is intended to receive appropriate document page feeds, as indicated by arrows 14, 16, from two devices. These two devices are represented by blocks 18, 20, and are referred to herein, respectively, as a page-feed structure associated with document pages flowing through and from a pre-fuser, and a page-feed structure associated with document pages flowing through and from a post-fuser, in system 10. These two page-feed structures are operatively connected to, and are effectively under the control of, a block shown at 22 which is referred to herein as a feed-control structure. Structure 22 includes appropriately within it a page-description-language (PDL) substructure 24, a PDL interpreter 26, and what is referred to herein as a ghost-page-creating substructure 28. The operative connections which exist between blocks 18, 20, 22 are represented generally at 30 in FIG. 1.

Indicated by dashed-dot lines 32, 34 are two document-page feed paths, or flow paths, or portions, which constitute, within system 10 as illustrated, a pre-fuser feed path, and a post-fuser feed path, or portion, respectively. Illustrated in feed path 32 are four real document pages 32*a*, 32*b*, 32*c* and 32*d*. Also illustrated in this same flow path, by dash-double-dot lines, are what are referred to herein as three ghost pages, 32*e*, 32*f* and 32*g*. Ghost page 32*e* sits between pages 32*a*, 32*b*. Ghost pages 32*f*, 32*g* sit, as shown, between pages 32*c*, 32*d*. The lineup of these real and ghost pages along path 32 is such that the order in which these pages will be "delivered" by block 18 to collator 12 is 32*a*, 32*e*, 32*b*, 32*c*, 32*f*, 32*g* and finally 32*d*. Thus, block 18 is to be engaged with the "handing and feeding" to collator 12 of seven successive pages, four of which are real document pages, and three of which are ghost pages (that have been created as will be explained shortly herein). In relation to the "feeding" of a ghost page, the associated feed structure is said to be operating "as if" to feed such a page, and such an "as if" page feed is referred to as a virtual feed.

Appearing in flow path 34 are three real document pages, shown at 34*a*, 34*b*, 34*c*. These three pages are ones that flow in what has been referred to as the post-fuser path, and it is these pages which bear, for example, color imagery which has been created in a divided flow path that was established for the overall document imaging now being discussed.

Also illustrated in FIG. 1 are double-ended arrows 36, 38, 40 which extend between pages 32*e*, 34*a*, pages 32*f*, 34*b*, and pages 32*g*, 34*c*, respectively, in the two flow paths. These arrows reflect an associative relationship that exists between the three ghost pages which "reside" in flow path 32, and the three real pages which are shown in flow path 34.

In accordance with practice of the present invention, the PDL which is associated with the document imaging or printing job that is reflected by the document pages shown in FIG. 1, has been created by substructure 24. This PDL includes specific page-feeding, handling, or pulling, instructions, including appropriate timing instructions, that relate to the specific manners in which documents in paths 32, 34 will actually be fed by structures 18, 20 to collator 12. Embedding of such page-handling instructions in the PDL for the job represented by the pages pictured in FIG. 1 is one of the important features of the present invention. It is a feature which yields a quite simple and uncomplicated resolution to the issue of just how to control appropriate, successive page feeds to a collator, such as collator 12.

These PDL embedded page-feed instructions are appropriately interpreted by PDL interpreter 26, which more directly controls the actual feed of real pages taking place under the actions of blocks 18, 20 in FIG. 1. This control causes correct hand off to take place to collator 12 regarding next-adjacent, successive pages in the document job. The instructions created by substructure 24, and implemented effectively by substructure 26, take into account the appropriate timing constraints that dictate how feed structures 18, 20 should operate in relation to documents that are provided to them via paths 32, 34, respectively. Such timing constraints assure that a continuous, successive page feed is received by the collator, just as if all pages were arriving at the collator from a single and undivided job-stream page flow.

Block 28 operates in accordance with practice of the invention, and in relation to block 24, to create virtual ghost pages, such as those shown at 32*e*, 32*f* and 32*g*. These ghost pages "sit" as if in reality they actually exist in the stream of pages present along flow path 32, and they stand there as surrogates for real pages 34*a*, 34*b*, 34*c*, respectively. These three real pages (34*a*, 34*b*, 34*c*), of course, under the control of blocks 26, 18, 20, will be fed to collator 12 at precisely the right moments in time, just as if they had actually been sitting for feeding in one continuous, correctly ordered stream of documents, i.e., not arriving from divided flow paths.

Turning attention to FIG. 2 in the drawings, and imagining, as was stated earlier, that flow paths 32, 34 are related to what are referred to herein, respectively, as a pre-fuser document-page tray and a post-fuser document page tray, in accordance with practice of the invention, both of these trays are specified in the job specific PDL as source input devices, effectively through blocks 18, 20 respectively, for the inputting of successive job pages to collator 12.

FIG. 2 illustrates how, for example, PDL language in a job control header might appear. Pages in the job which are to be printed are, generally speaking, specified in the so-called PDL syntax, where each page is generally broken down into a page preamble followed by page data. The page preamble describes how a page is to be laid out on a sheet, while the page-data describes the contents of the page to be printed on the sheet. For example, the page preamble might consist of one or more of the following types of commands:

1. Media Input Source—from which tray to pull the sheet for this page.
2. Page Size—size of page image on sheet
3. Resolution—resolution (e.g., dpi) of printed image
4. Orientation—Location of origin on the sheet.
5. Print Direction—Direction of print data on the sheet
6. Picture Frame—Boundary within sheet to print the page into.
7. Cursor Position—Initial cursor (e.g., pen) position within picture frame Each preamble command is generally formed as an opcode followed by one or more operands, and an explicate (e.g., ;) or implicit delineation (e.g., instruction size specified by opcode). In the case of a page source input command, the operand would specify which "tray" the page is to be pulled from. With respect to a page which is to follow a path, such as path 34 in FIG. 1, one operand value would refer to the post-fuser tray as the source for that page.

By so specifying in PDL just how and from where a particular page is to be drawn for feeding, control over plural-path feeding of document imaging jobs which are based upon a split document page flow can be handled in a very simple and straight forward manner. FIG. 2 helps to illustrate how PDL data arrangement can accommodate this behavior in accordance with practice of the invention.

As was suggested earlier, it is important that PDL control implemented in accordance with practice of the invention, and under the auspices of block 22 in FIG. 1, be accomplished in such a manner that appropriate timing is introduced into control instructions so that pages drawn for split paths, such as paths 32, 34, actually arrive at, for example, collator 12 at the right moments in time.

Figure 3:
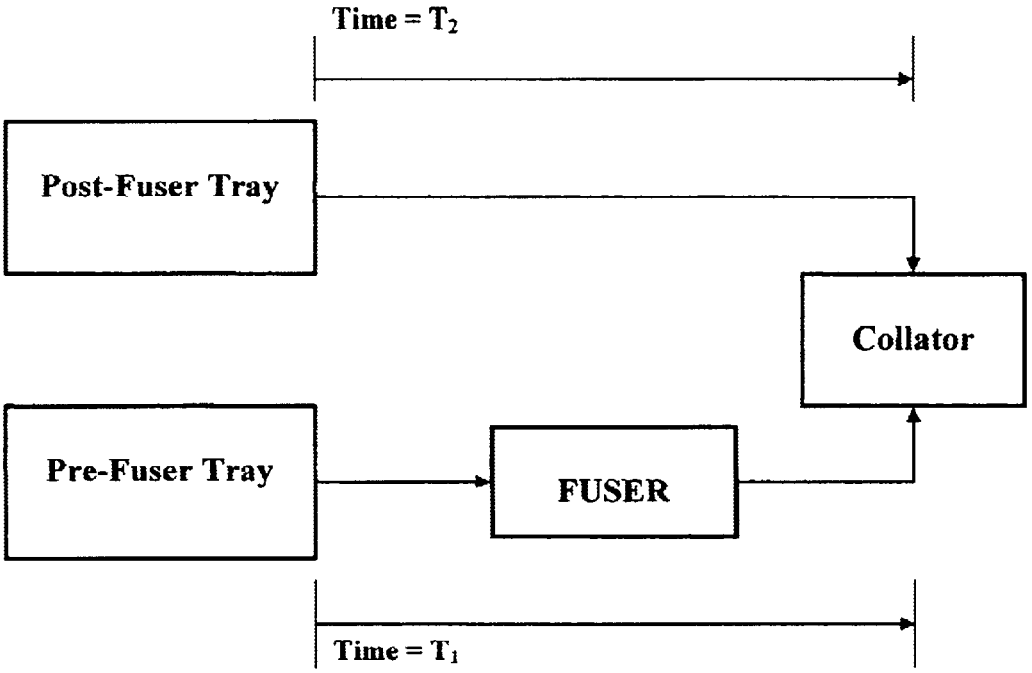
FIG. 3 is a block/schematic diagram illustrating, in a system which includes both a pre-fuser document page tray and a post-fuser document page tray, the appropriate control of page-feed timing considerations in accordance with practice of the present invention.

FIG. 3 in the drawings diagrams this important timing consideration as addressed by practice of the present invention.

Figure 4:
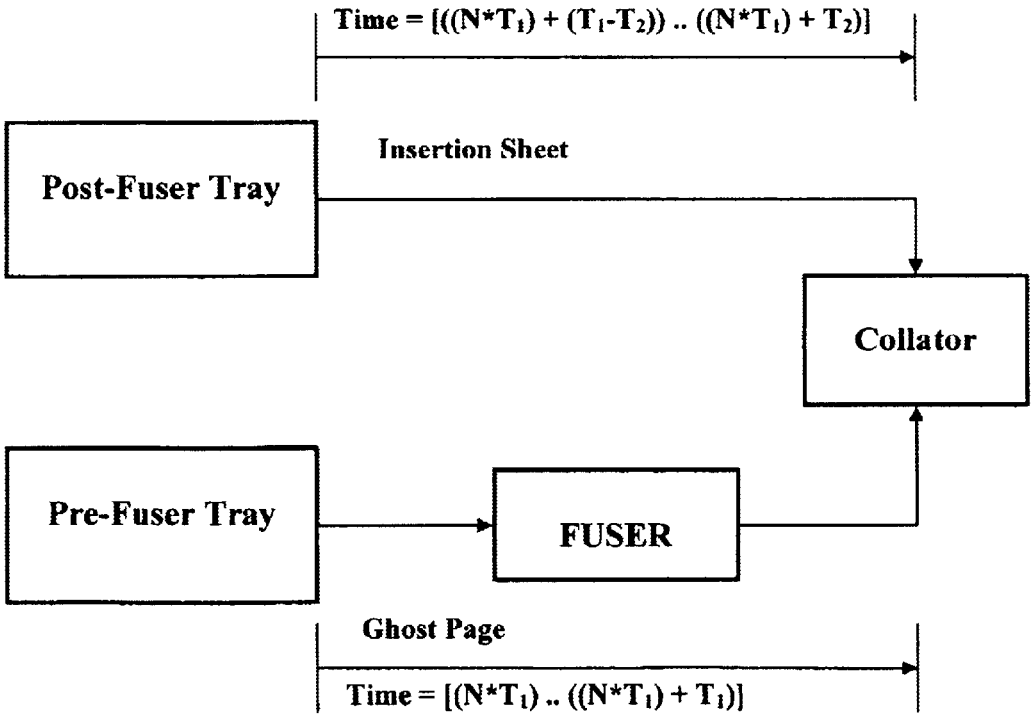
FIG. 4 is a block/schematic diagram illustrating what is referred to herein as ghost page insertion in a pre-fuser document page flow path.

FIG. 4 in the drawings, in addition to describing further various timing considerations that are important with respect to the feeds of document pages from split flow paths, such as paths 32, 34 illustrates the practice according to the invention of the creation and implementation of so-called ghost pages, such as previously mentioned ghost pages 32*e*, 32*f*, 32*g*.

For example, and as pictured in FIG. 4, the arrival of an inserted sheet into the collator is timed to appear in the correct order with the arrival of pre-fuser printed sheets. This is accomplished by delaying the release of the post-fuser sheets by the difference in timing of the fuser and post-fuser paths, and the running of appropriate ghost pages simultaneously, and effectively through and along the fuser path. In the example specifically illustrated in FIG. 4, this timing difference is $(T_1-T_2)$.

As should be apparent, a ghost page, in accordance with the present invention, is a surrogate in the so-called post-fuser flow path which acts as if a physical sheet was actually present, but of course is not so present.

In the illustration presented graphically in FIG. 4, the first N sheets are pulled from the page tray associated with pre-fuser path 32. The N+1 sheet is pulled from the document page tray associated with post-fuser path 34 in FIG. 1. Subsequent sheets N+2 . . . N+X are pulled from either or both the pre- and post-fuser path-associated page trays.

Further describing what is pictured in FIG. 4, the first N sheets are pulled from the pre-fuser path tray, and the last sheet arrives in the collator at time ($N*T_1$). The next sheet (i.e., N+1) is pulled from the post-fuser tray. The release of the sheet from the input tray is delayed by ($T_1-T_2$), which is the time difference between the pre-fuser and post-fuser media source path. Simultaneously, a ghost page (i.e. no physical page) will travel through the pre-fuser path corresponding to the timing of the pre-fuser media path $T_1$. With the above timing, the N+1 post-fuser sheet arrives in the collator after the Nth page, and arrives at the identical time as does the ghost page from the pre-fuser path.

There is thus described and illustrated herein, a unique approach to the handling of split-stream document imaging jobs, such as printing, scanning, faxing, copying imaging jobs, where splitting has occurred for any one of a number of reasons.

Through employment of PDL command implementation which involves embedded page-feed instructions in accordance with the particular path from which a page is to be fed, by recognizing the appropriate and necessary timing information that needs to be addressed with respect to the page-handling characteristics of different flow paths, and by incorporating ghost pages as real page surrogates which are in-fed from a lateral flow path, a very straight forward, and easily and inexpensively implemented system and methodology are proposed for handling split-path printing jobs. While a preferred and best mode embodiment of the invention, and manner of practicing the same, have been described and illustrated herein, it is appreciated that variations and modifications may be made, all of which come within the scope of the present invention.

I claim:

1. A system for correctly collating successive pages of a document in a document imaging job where performance of that job has involved a divided, plural-stream, page-flow approach, with different pages in the job following two different paths through the job toward a collator which is to be fed successive job pages by the system, and each of such paths includes a pre-fuser portion and a post-fuser portion, said system comprising page-feed structure for each different path, disposed upstream from such a collator, and each positioned to receive pages that have followed its associated path, each page-feed structure being constructed to feed such received pages to the collator, with one of said page-feed structures being specifically associated with the pre-fuser portion of one of such paths, and the other page-feed structure being specifically associated with the post-fuser portion of the other path, and feed-control structure operatively connected to said page-feed structures, and cooperatively controlling the operations thereof whereby, collectively for said page-feed structures, plural operating modalities exist therefor, one modality involving feeding to the collator of the appropriate, next-successive job page relative to the last prior page received by the collator, with such feeding occurring from whichever one of said page-feed structures is responsible for such next-page feeding activity, and another modality involving the suspension of page feeding by the page-feed structure which is specifically associated with the pre-fuser portion of the mentioned one path, and where the next page associated with that feed structure is not the correct, next-successive page in the job document relative to the prior page received by the collator.

2. The system of claim 1, wherein said feed-control structure includes page description language (PDL) substructure operable to place, within a given document in the job, page-feed instructions within the PDL language associated with that job, which instructions are effective to implement, via said feed-control structure, said one and other operating modalities.

3. The system of claim 2, wherein said PDL substructure includes a PDL interpreter which interprets such page-feed instructions to effect said feed-control structure's implementations of said operating modalities.

4. The system of claim 3, wherein said PDL interpreter is structured in such a manner that its operation, in relation to interpreting such page-feed instructions, is effective to treat each of said page-feed structures as a source input device relative to the collator.

5. The system of claim 1, wherein said feed-control structure includes ghost-page-creating substructure operable to effect the operations of said page-feed structures in a manner whereby at least one of said page-feed structures, regarding implementation of said operating modalities, is operated as if to feed a ghost page created by said ghost-page-creating substructure.

6. A method for correctly collating successive pages of a document in a document imaging job where performance of that job has involved a divided, plural-path, page-flow approach, with different pages in the job following different flow paths through the job toward a collator which is to be fed successive job pages for completion of the job, and wherein each of such paths includes a pre-fuser portion and a post-fuser portion, said method comprising creating, in job-specific, page-description-language (PDL), page-feed instructions relevant to the job, which instructions recognize the fact that the job has involved a divided, plural-stream flow of job pages, and implementing such PDL instructions in a manner whereby there occurs a correct, successive feed of next-adjacent document pages from the respective plural flow paths to the collator, and where said implementing includes suspension of page feed in the re-fuser portion of one of the mentioned paths.

7. The method of claim 6, wherein said implementing involves the creation, for page-feeding purposes, of one or more ghost page(s) that act(s) in one of such flow paths as a virtual-feed job-page surrogate for an associated, real job page which resides in another flow path.

8. A system for correctly collating successive pages of a document in a document imaging job where performance of that job has involved a divided, plural-stream, page-flow approach, with different pages in the job following different paths through the job toward a collator which is to be fed successive job pages by the system, said system comprising page-feed structure for each different path, disposed upstream from such a collator, and each positioned to receive pages that have followed its associated path, each page-feed structure being constructed to feed such received pages to the collator, and feed-control structure including ghost-page-creating substructure operatively connected to said page-feed structures, and cooperatively controlling the operations thereof whereby, for each page-feed structure, plural operating modalities exist therefor, one modality involving feeding to the collator of the appropriate, next-successive job page relative to the last prior page received by the collator, with such feeding occurring from whichever one of said page-feed structures is responsible for such next-page feeding activity, and another modality involving the suspension of page feeding by one of said page-feed structures where the next page associated with that page-feed structure is not the correct, next-successive page in the job document relative to the prior page received by the collator, such suspension occurring through the action of said ghost-page-feeding substructure to cause said one page-feed structure to operate as if to feed a ghost page created by the ghost-page-feeding substructure.

9. A method for correctly collating successive pages of a document in a document imaging job where performance of that job has involved a divided, plural-path, page-flow approach, with different pages in the job following different flow paths through the job toward a collator which is to be fed successive job pages for completion of the job, said method comprising creating, in job-specific, page-description-language (PDL), page-feed instructions relevent to the job, which instructions recognize the fact that the job has involved a divided, plural-stream flow of job pages, and implementing such PDL instructions in a manner whereby there occurs a correct, successive feed of next-adjacent document pages from the respective plural flow paths to the collator, and wherein said implementing involves the creation, for page-feeding purposes, of one or more ghost page(s) that act(s) in one of such flow paths as a virtual-feed page-job surrogate for an associated, real job page which resides in another flow path.

* * * * *

UNITED STATES PATENT AND TRADEMARK OFFICE

CERTIFICATE OF CORRECTION

PATENT NO. : 6,850,731 B2
DATED : February 1, 2005
INVENTOR(S) : Andrew R. Ferlitsch It is certified that error appears in the above-identified patent and that said Letters Patent is hereby corrected as shown below:

Column 6,
Line 48, change “re-fuser” to -- pre-fuser --.

Column 8,
Line 7, change “relevent” to -- relevant --.

Signed and Sealed this

Twenty-fourth Day of May, 2005

JON W. DUDAS
*Director of the United States Patent and Trademark Office*